US011446693B2

(12) United States Patent
Alexander et al.

(10) Patent No.: US 11,446,693 B2
(45) Date of Patent: Sep. 20, 2022

(54) PRESSURE WASHER SAFELY LOCK

(71) Applicant: FNA Group, Inc., Pleasant Prairie, WI (US)

(72) Inventors: Gus Alexander, Inverness, IL (US); Paulo Rogerio Funk Kolicheski, Gurnee, IL (US); Richard J. Gilpatrick, Burlington, WI (US)

(73) Assignee: FNA GROUP, INC., Pleasant Prairie, WI (US)

( * ) Notice: Subject to any disclaimer, the term of this patent is extended or adjusted under 35 U.S.C. 154(b) by 0 days.

(21) Appl. No.: 15/962,192

(22) Filed: Apr. 25, 2018

(65) Prior Publication Data

US 2018/0304292 A1 Oct. 25, 2018

Related U.S. Application Data

(60) Provisional application No. 62/489,738, filed on Apr. 25, 2017.

(51) Int. Cl.
*B05B 12/00* (2018.01)
*B05B 3/02* (2006.01)
(Continued)

(52) U.S. Cl.
CPC ..... *B05B 12/002* (2013.01); *B05B 12/0026* (2018.08); *B08B 3/028* (2013.01); *B05B 9/01* (2013.01)

(58) Field of Classification Search
CPC ..... B05B 12/002; B05B 12/0022; B05B 12/0026; B05B 9/01; B08B 3/028
(Continued)

(56) References Cited

U.S. PATENT DOCUMENTS 1,797,209 A * 3/1931 Bramsen ..... B05B 12/002 239/300
2,641,087 A * 6/1953 Greiser ..... F16K 7/06 251/238
(Continued)

FOREIGN PATENT DOCUMENTS

CN 2907914 Y 6/2007
CN 106232241 A 12/2016
(Continued)

OTHER PUBLICATIONS

Further Examination Report issued in New Zealand Application No. 741930 dated Jan. 23, 2019.
(Continued)

*Primary Examiner* — Joseph A Greenlund
(74) *Attorney, Agent, or Firm* — Steven E. Jedlinski; Jeffrey T. Placker; Holland & Knight LLP

(57) ABSTRACT

A pressure washer gun is provided including a safety locking feature that may inhibit unintentional actuation. In an embodiment, the pressure washer gun may include a body portion, and a hand grip portion extending from the body portion. A trigger may be disposed adjacent to the hand grip portion and coupled with a flow control valve for controlling the flow of high pressure fluid through the pressure washer gun. A safety lock may be pivotally coupled with the hand grip portion for movement between a locked position inhibiting movement of the trigger to open the flow control valve, and an unlocked position allowing movement of the trigger to open the flow control valve, the safety lock being biased toward the locked position.

14 Claims, 14 Drawing Sheets

(51) Int. Cl.
*B05B 9/01* (2006.01)
*B08B 3/02* (2006.01)

(58) Field of Classification Search
USPC ..... 239/562, 526
See application file for complete search history.

(56) References Cited

U.S. PATENT DOCUMENTS 2,690,321 A * 9/1954 Luna ..... F16K 21/04 74/516
4,676,437 A 6/1987 Brown
4,709,859 A * 12/1987 Schulze ..... B05B 1/3013 239/525
4,784,330 A * 11/1988 Hammelmann ..... B05B 9/01 251/99
4,802,313 A * 2/1989 Smith ..... B24C 5/02 251/109
4,821,927 A * 4/1989 Paulsen ..... B05B 9/01 222/441
4,880,166 A * 11/1989 Suttner ..... B05B 12/002 239/526
4,925,107 A * 5/1990 Brown ..... B05B 12/0026 239/526
5,176,327 A * 1/1993 Petersen ..... B05B 12/0026 239/525
5,636,789 A * 6/1997 Shook ..... B05B 9/01 239/526
5,662,273 A * 9/1997 Chih ..... B05B 12/002 239/526
5,692,663 A * 12/1997 Yang ..... B25C 1/047 227/8
5,791,564 A * 8/1998 Carra ..... B05B 12/0026 239/526
5,979,800 A * 11/1999 Takagi ..... B05B 1/308 239/440
6,021,961 A * 2/2000 Brown ..... B29B 7/7438 239/428
6,460,787 B1 * 10/2002 Hartle ..... B05B 7/1263 239/691
6,929,165 B1 * 8/2005 Chen ..... B25C 1/008 227/8
7,090,150 B2 * 8/2006 Amaduzzi ..... B05B 12/002 251/238
7,231,944 B2 * 6/2007 Magno, Jr. ..... B65B 13/027 140/93.2
7,389,949 B2 * 6/2008 Marchand ..... B05B 9/01 251/102
7,516,910 B1 * 4/2009 DeWall ..... B05B 12/0026 239/525
8,201,946 B2 6/2012 Horikoshi
8,225,964 B2 * 7/2012 Clark ..... B05B 12/0026 222/323
9,623,427 B2 * 4/2017 Gilpatrick ..... B05B 7/32
10,589,303 B2 * 3/2020 Johnston ..... B05B 1/3046
11,156,424 B1 * 10/2021 Cai ..... F41A 33/02
2004/0118947 A1 6/2004 Amaduzzi
2004/0195383 A1 * 10/2004 Amaduzzi ..... B05B 1/302 239/526
2006/0131151 A1 * 6/2006 Marchand ..... B05B 12/0026 200/336
2007/0051834 A1 * 3/2007 Dexter ..... B05B 12/0026 239/528
2007/0228190 A1 * 10/2007 Tanner ..... B05B 1/302 239/526
2009/0050716 A1 * 2/2009 Binder ..... B05B 9/01 239/526
2009/0071998 A1 * 3/2009 Nakano ..... B25C 1/008 227/8
2009/0308892 A1 * 12/2009 Clark ..... B05B 12/0026 222/1
2011/0089265 A1 * 4/2011 Gilpatrick ..... F16L 37/47 239/526
2012/0018540 A1 * 1/2012 Gilpatrick ..... B05B 7/2478 239/526
2014/0263699 A1 * 9/2014 Hedger ..... B29B 7/761 239/8
2014/0346257 A1 * 11/2014 Reetz, III ..... B05B 12/0026 239/526
2016/0303596 A1 * 10/2016 Tullney ..... B05B 15/63
2018/0304292 A1 * 10/2018 Alexander ..... B05B 12/002
2019/0070621 A1 * 3/2019 Salmons ..... B05B 9/01
2019/0321838 A1 * 10/2019 Theis ..... B05B 15/65

FOREIGN PATENT DOCUMENTS

DE 102005040083 A1 3/2007
EP 0773071 A1 10/1996
EP 1430954 A2 6/2004
GB 2177942 A 2/1987

OTHER PUBLICATIONS

Canada First Office Action issued in Application No. 3,002,468 dated Feb. 26, 2019.
Examination Report No. for standard patent application issued in Australian Application No. 2018202852 dated Apr. 18, 2019.
First Examination Report issued in counterpar New Zealand Application Serial No. 741930 dated Jul. 9, 2018.
Chinese First Office Action issued in related Chinese Patent Application No. 201810383323.1 dated Dec. 21, 2020.
Decision of Rejection issued in Chinese Patent Application No. 201810383323.1 dated Jul. 1, 2022 (with machine translation).

* cited by examiner

100

PRESSURE WASHER SAFELY LOCK

CROSS-REFERENCE TO RELATED APPLICATION

This application claims the benefit of U.S. provisional patent application Ser. No. 62/489,738, filed on Apr. 25, 2017, entitled "Pressure Washer Safety Lock," the entire disclosure of which is incorporated herein by reference.

TECHNICAL FIELD

The present disclosure generally relates to pressure washer systems including a trigger actuated gun, and more particularly relates to safety lock devices for reducing the unintentional actuation of the trigger of the pressure washer gun.

BACKGROUND

Pressure washers typically includes a motor or engine driven pump to provide a flow of high pressure fluid, such as water, from a relatively lower pressure source, such as a municipal water supply. The high pressure fluid is typically provided through an output hose or passageway to a user controllable system, such as a pressure washer gun, which may allow the user to control and direct the flow of the high pressure fluid. For example, the gun may allow a user to selectively permit the flow of the high pressure fluid, and to direct the high pressure fluid toward a working surface, such as a surface to be cleaned or worked upon by the high pressure fluid. The gun is typically in fluid communication with the pressure washer and includes a valve for discharging and discontinuing the flow of the high pressure fluid through the gun. The valve is often controlled by a trigger, which may be actuated by the user. For example, the user may squeeze the trigger with one hand to initiate the discharge of the fluid from the gun.

SUMMARY

According to an implementation a pressure washer gun may include a body portion, and a hand grip portion extending from the body portion. A trigger may be disposed adjacent to the hand grip portion and coupled with a flow control valve for controlling a flow of high pressure fluid through the pressure washer gun. The pressure washer gun may further include a safety lock pivotally coupled with the hand grip portion for movement between a locked position inhibiting movement of the trigger to open the flow control valve, and an unlocked position allowing movement of the trigger to open the flow control valve. The safety lock may be biased toward the locked position.

One or more of the following features may be included. The safety lock may be pivotally moveable between the locked position and the unlocked position. The safety lock may be biased toward the locked position by a torsion spring. The safety lock may extend between the trigger and the hand grip portion in the locked position. The safety lock may be at least perpendicular to a contacting surface of the trigger.

The trigger may be coupled with the flow control valve via an intermediary linkage. The safety lock may act on the intermediary linkage to inhibit movement of the trigger opening the flow control valve. The intermediary linkage may be pivotally coupled relative to the hand grip portion. In the locked position, the safety lock may contact the intermediary linkage outside of an intersection between a rotational arc associated with the intermediary linkage and a rotational arc associated with the safety lock. The intermediary linkage may slidingly engage a rear surface of the trigger. Pivoting of the trigger may result in sliding movement of the intermediary linkage across the rear surface of the trigger and pivotal movement of the intermediary linkage relative to the hand grip portion.

The hand grip portion may include a recess. The safety lock may be at least partially disposed within the recess when the safety lock is in a fully unlocked position. The safety lock may include one or more laterally extending features extending laterally a width greater than a width of the trigger. The laterally extending features may have a contour complementary to a contour of an adjacent region of the hand grip portion. One or more of the trigger and the safety lock may include a stop feature establishing a fully locked position of the safety lock.

The intermediary linkage may include a stop feature establishing a fully locked position of the safety lock. The pressure washer gun may include guard extending around at least a portion of the trigger, inhibiting actuation of the trigger by external objects.

According to another implementation, a pressure washer gun may include a body portion, and a hand grip portion extending from the body portion. The pressure washer gun may also include a trigger disposed adjacent to the hand grip portion and pivotally coupled relative to the body portion. A linkage may be pivotally coupled relative to the hand grip portion, and interacting with the trigger for pivotal movement of the linkage in response to pivotal movement of the trigger. The linkage may be coupled with a flow control valve for controlling a flow of high pressure fluid through the pressure washer gun. The pressure washer gun may also include a safety lock pivotally coupled with the hand grip portion for movement between a locked position inhibiting movement of the linkage to open the flow control valve, and an unlocked position allowing movement of the linkage to open the flow control valve. The safety lock may be biased toward the locked position One or more of the following features may be included. At least one surface of the linkage may slidingly contact at least one surface of the trigger during pivotal movement of the trigger to result in pivotal movement of the linkage. The linkage may be biased against the trigger toward a closed position of the flow control valve. The pressure washer gun may include a guard extending around at least a portion of the trigger. The guard may include a stop feature establishing a fully open position of the trigger.

According to yet another implementation, a pressure washer gun may include a body portion, and a hand grip portion extending from the body portion. The hand grip portion may include a flow control valve at least partially disposed therein. The flow control valve may control a flow of high pressure fluid through the pressure washer gun. The pressure washer gun may include a trigger disposed adjacent to the hand grip portion and pivotally coupled relative to the body portion. The pressure washer gun may also include a linkage pivotally coupled relative to the hand grip portion and slidingly contacting the trigger for pivotal movement of the linkage in response to pivotal movement of the trigger. The linkage may be coupled with the flow control valve. The pressure washer gun may also include a safety lock pivotally coupled with the hand grip portion for movement between a locked position inhibiting movement of the linkage to open the flow control valve, and an unlocked position allowing movement of the linkage to open the flow control valve. The safety lock may be biased toward the locked position. The pressure washer gun may further include a guard extending around at least a portion of the trigger. The guard may include a stop feature establishing a fully open position of the trigger.

BRIEF DESCRIPTION OF DRAWINGS

FIGS. 12A-12C depict another illustrative example of a pressure washer gun including a safety lock;

DETAILED DESCRIPTION OF EXAMPLE EMBODIMENTS

The present disclosure may generally provide a pressure washer gun including a safety mechanism that may reduce the likelihood of unintentional discharge of high pressure fluid from the pressure washer gun. In some embodiments, the safety mechanism may include a mechanism that may reside in a first (e.g., "engaged" or "locked") position in which the safety mechanism may inhibit movement, or travel, of the trigger, or other intermediary feature, to a sufficient degree to open a flow control valve within the gun. The safety mechanism may be moveable to a second (e.g., "disengaged" or "unlocked") position that may allow movement, or travel, of the trigger, or other intermediary feature, to a sufficient degree to permit the flow control valve within the gun to be opened, thereby permitting flow of the high pressure fluid through the gun and allowing discharge of the high pressure fluid from the gun. In some embodiments, movement of the safety mechanism from the first position to the second position may require an affirmative action by the user. As such, the safety mechanism may, in some embodiments, reduce the unintended actuation of the trigger. In some embodiments, the safety mechanism may include a moveable feature that may be biased toward the first position. The biasing force of the mechanism may be overcome by a user to move the safety mechanism to the second position.

Figure 1:
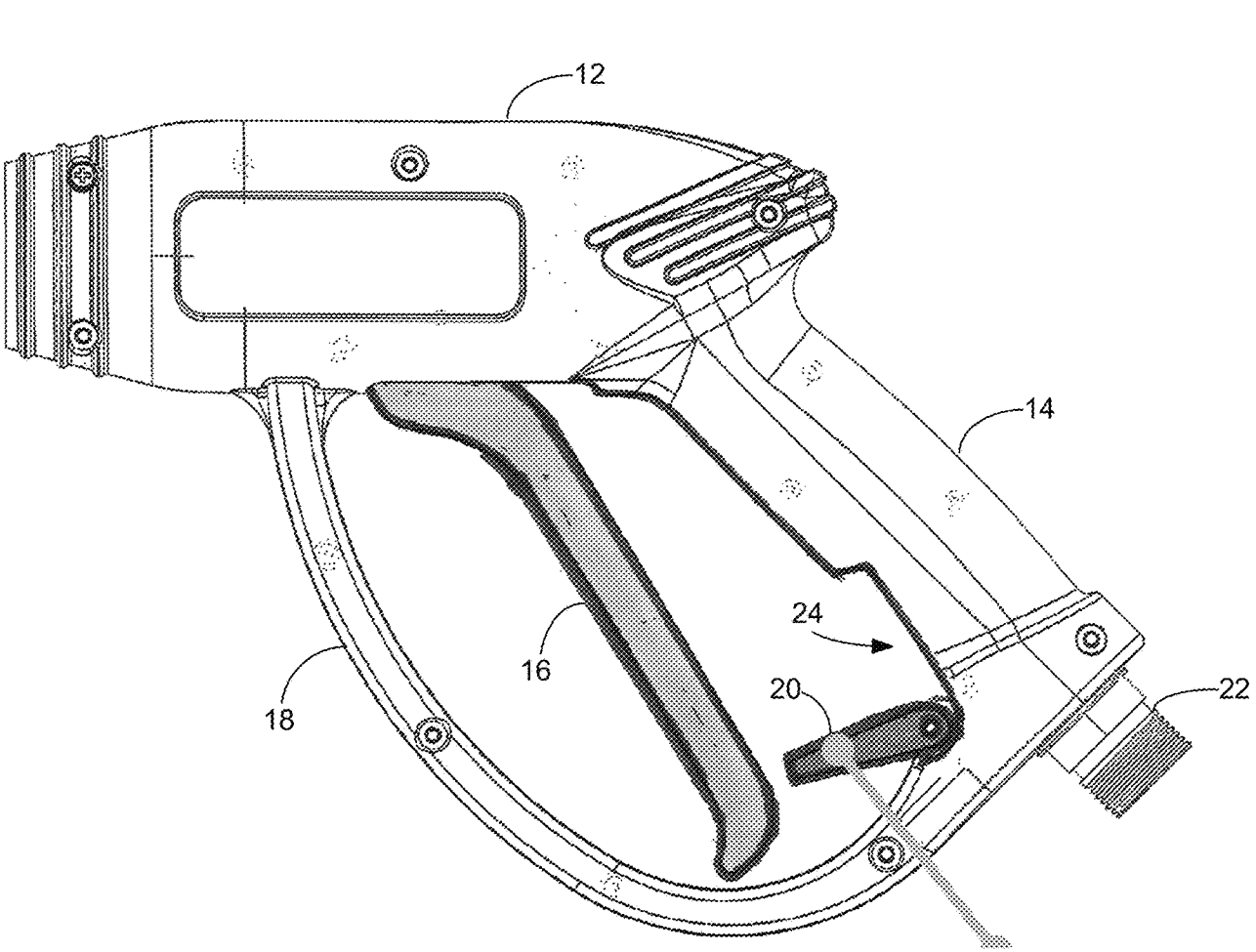
FIG. 1 depicts an illustrative example of a pressure washer gun including a safety lock in the locked position.

With reference to FIG. 1, an illustrative example of a pressure washer gun 10 is generally depicted. As shown, the gun 10 may generally include a body portion 12 and a hand grip portion 14. A trigger 16 may be disposed adjacent the hand grip 14 portion, e.g., to facilitate actuation (such as by squeezing) of the trigger 16 by a user holding the gun 10. In some implementations, the gun 10 may further include a guard 18. The guard 18 may provide physical barrier around at least a portion of the trigger 16 (e.g., the forward edge of the trigger) that may generally inhibit external objects from applying a force to the trigger 16 (e.g., in the direction that the trigger may be squeezed during actuation). In an example embodiment, the guard 18 may extend between the body portion 12 and the hand grip portion 14 in front of the trigger 16. In some such embodiments, the trigger 16 may generally be surrounded, at least in one plane, by the body portion 12, the hand grip portion 14, and the guard 18. The gun 10 may further include a safety lock 20, which may generally inhibit the unintended actuation of the trigger 16 by the user, as well as by other external objects. In some embodiments, one or more of the body portion 12, the hand grip portion 14, and the guard 18 may be integrally formed, and/or may include separate components or features. Various features of example embodiments of the gun 10 are described in greater detail below.

As generally described above, a gun consistent with the present disclosure (e.g., gun 10) may include a body portion 12. In some embodiments, the body portion 12 may house a flow control valve, which may selectively permit or prevent the flow of high pressure fluid through the gun 10 (e.g., from the pressure washer pump and exiting via an outlet of the gun). It will be appreciated that a wide variety of valves may be utilized to this effect, and may include at least a closed position and an open position. In some embodiments, suitable valves may include one or more intermediate positions between the open position and the closed position (e.g., thereby providing at least some degree of control over the level or amount of flow). For example, a suitable valve may generally include a sealing feature (e.g., such as a poppet or ball) on an inlet side of the valve that may be biased (e.g., via a spring or other biasing features) against a valve seat downstream of the inlet side of the valve. An actuator may act against the sealing feature to move the sealing feature away from the valve seat and permit flow of the high pressure fluid through the valve (e.g., and thereby permit flow of the high pressure fluid through the gun). It will be appreciated that various other valve configuration may also be utilized. As noted above, in some implementations, the valve may generally operate as an on-off valve, with relatively little ability to control or modulate the flow rate through the valve. In other implementations, in addition to preventing and permitting flow of the high pressure fluid through the gun 10, the valve may be capable of controlling a flow rate through the gun 10 (e.g., by controlling the degree of opening of the valve in a meaningful manner). Further, it will be appreciated that while the illustrative example has described the valve as being contained within the body portion 12, in other implementations the valve may be partially, or entirely, in another portion of the gun 10 (e.g., partially, or entirely, within the hand grip portion 14, and/or within another portion of the gun).

In addition to containing the valve, the body portion 12 may include, and or be configured to be coupled with, a nozzle or wand. As is generally known, a wand of a pressure washer gun may include an, often elongated, fluid conduit that may extend the discharge from the gun 10 further from the hand grip portion 14. Typically the wand may include a generally rigid member (e.g., which may allow control of the discharged high pressure fluid), and may include a nozzle (e.g., which may be fixed or replaceable, allowing various different nozzles to be used in connection with the same gun). The wand may be removably coupled to the body portion 12 (e.g., mechanically coupled to the body portion and/or fluidly coupled with the outlet of the valve) in a variety of manners, including generic and/or proprietary quick disconnect type fittings, threaded fittings, and the like. Nozzles used in connection with the pressure washer gun 10 may, for example, control the spray type and pattern of the discharged high pressure fluid. Such nozzles may often be removably coupled directly to the pressure washer gun, and/or may be removably coupled to a wand, which may be coupled to the pressure washer gun 10.

The hand grip portion 14 of the pressure washer gun 10 may generally facilitate holding of the gun 10 by a user, as well as control, and/or ergonomic handling of the gun 10 (e.g., to allow the user to appropriately aim and control the discharged stream of high pressure fluid). The grip portion 14 of the gun 10 may generally extend from body portion 12. As generally mentioned above, the hand grip portion 14 of the gun 10 may be integrally formed with the body portion 12, and/or may include a separate component of the gun 10 (e.g., structurally as well as conceptually). In some embodiments, the hand grip portion 14 may also include an attachment (22, generally) for the supply of high pressure fluid from the pressure washer pump. The attachment 22 may include any suitable fluid coupling, such as a threaded coupling, a quick disconnect coupling, or the like. The hand grip portion 14 may include a fluid passage from the attachment 22 to the valve. In other implementations, the attachment for the supply of high pressure fluid from the pressure washer pump may be associated with other portions of the gun 10 (e.g., the body portion 12).

The trigger 16 may be actuated by a user for controlling the flow of high pressure fluid through the gun 10. For example, the trigger 16 may by coupled with the valve for opening and closing the valve. The trigger may be coupled with the valve directly (e.g., with at least a portion of the trigger acting directly against the valve sealing feature), and/or may be indirectly coupled with the valve through various features and/or mechanical couplings, linkages, or the like. A user may actuate the trigger 16 for controlling the flow of high pressure fluid through the gun 10, e.g., by squeezing the trigger 16. According to various implementations, the trigger 16 may provide a pivoting action, a sliding action, or a combination of a pivoting and sliding action during actuation. According to an illustrative embodiment, the trigger 16 may be pivotally coupled to the body portion 12, and may pivot toward the hand grip portion 14 when squeezed by a user. In some implementations, the trigger 16 may be biased toward a position in which the flow control valve may be in the closed position (e.g., preventing flow of high pressure fluid through the gun). In some such embodiments, spring or other biasing feature may act directly on the trigger 16. In other embodiments, a spring or other biasing feature may act through one or more other features, include, but not limited to, the flow control valve, an intermediary coupling or linkage, and/or may otherwise indirectly act on the trigger 16. As such, in various embodiments, one or more of the trigger, an intermediary feature, and/or the flow control valve may be biased toward a position that may be associated with a closed position of the flow control valve.

The safety lock 20 may generally include a member that may be disposed between at a portion of the trigger 14 and one or more of the hand grip portion 14 and the body portion 12. For example, as shown in the illustrative example embodiment of FIG. 1, the safety lock 20 may be disposed between at least a portion of the trigger 16 and at least a portion of the hand grip portion 14. As generally discussed above, the safety lock 20 may reduce the likelihood of the trigger 16 being unintentionally actuated. For example, the safety lock 20 may require additional actuation step or motion by the user to move the safety lock 20 to an unlocked position before the trigger 16 can be squeezed to actuate the valve.

With particular reference to the illustrative example embodiment shown in the drawings, the safety lock 20 may include a member that is pivotally coupled to the hand grip portion 14 of the gun 14 (e.g., via a pin, or other suitable features of the safety lock 20 and/or hand grip portion 14, or through other suitable arrangements), and may be pivotally moveable between a first, "locked," position and a second, "unlocked," position. In an embodiment, the safety lock 20 may be biased toward the first (i.e., locked) position. For example, safety lock 20 may include a biasing member, such as a spring, that may bias the safety lock 20 toward the first position. It will be appreciated that a variety of biasing features may be utilized to bias the safety lock 20 toward the first position, including, but not limited to, a torsion spring, a compression spring, an extension spring, an elastic member, or the like, as well as various combinations of features. As shown in FIG. 1, when the trigger 16 is in the released position (e.g., in which the valve is closed preventing the flow of high pressure fluid through the gun 10), the safety lock 20 may move (e.g., by virtue of the biasing force) toward the first, "locked," position. In the first position, the safety lock may generally extend between the hand grip portion 14 and the trigger 16 a sufficient amount to prevent the trigger 16 from being squeezed enough to open the valve. According to various embodiments, the safety lock 20 may still permit some degree of squeezing or travel of the trigger 16, but the permitted degree of squeezing or travel may be insufficient to result in the opening, or at least the complete opening, of the valve. In other implementations, the safety lock 20 may prevent any substantial squeezing or travel of the trigger 16. In some implementations, when the safety lock 20 is in the first position the safety lock 20 may be generally oriented perpendicular to the trigger 16 and/or generally oriented tangentially to the pivotal travel of the trigger 16. As such, the safety lock 20 may resist pivotal movement toward the second, "unlocked," position as a result of a force applied to the safety lock 20 by the trigger. In this regard, in the first position, the safety lock 20 may be oriented beyond (i.e., for an angle greater than) perpendicular and/or tangential to the trigger 16. In such a configuration, a force applied by squeezing the trigger 16 against the safety lock 20 may tend to bind the safety lock 20 in the first position (e.g., by forcing the safety lock 20 against a stop or interfering surface of the hand grip portion 14, the guard 18, and/or the trigger 16).

Figure 2:
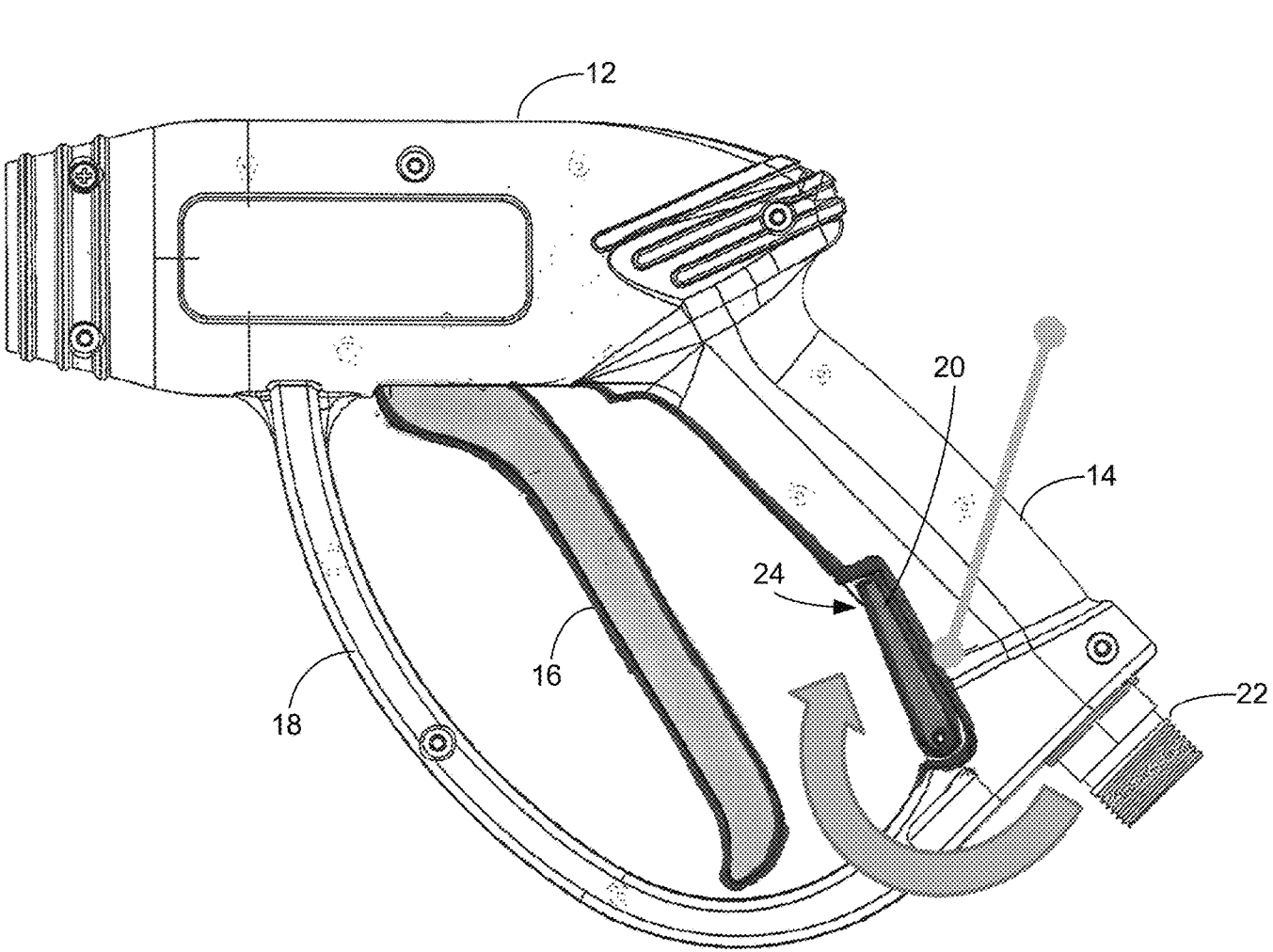
FIG. 2 depicts the illustrative example of the pressure washer gun according to FIG. 1 with the safety lock in the unlocked position.
Figure 3:
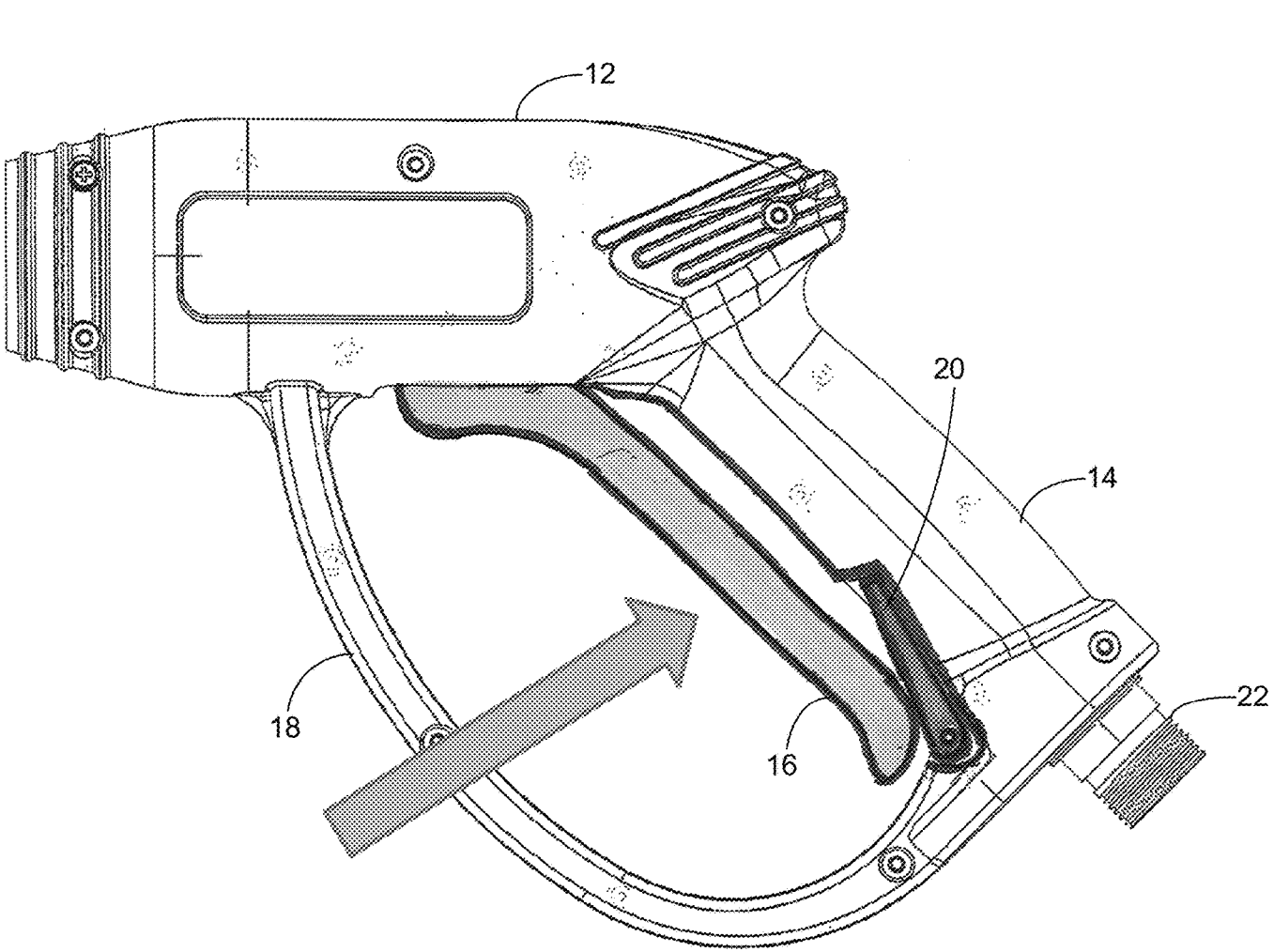
FIG. 3 depicts the illustrative example of the pressure washer gun according to FIG. 1 with the safety lock in the unlocked position and the trigger in the depressed position.

As generally discussed above, the safety lock 20 may be pivotally moved from the first, "locked," position to the second, "unlocked," position, to thereby allow actuation of the trigger 16. For example, and referring also to FIG. 2, in order to actuate the trigger 16 to initiate a flow of high pressure fluid through the gun 10, the user may pivotally move the safety lock 20 (e.g., against the biasing force) to the second, "unlocked," position. As shown, in the unlocked position the safety lock 20 may no longer substantially extend between the hand grip portion 14 and the trigger. As such, the trigger may then be squeezed, as shown in FIG. 3, a sufficient degree to open the valve, and/or fully open the valve, to permit the flow of the high pressure fluid through the gun 10. In some implementations, when the safety lock 20 has been moved partially toward the second position (e.g., greater than a threshold amount of pivotal movement), squeezing the trigger 16 may provide a force urging the safety lock 20 toward the second, "unlocked," position. For example, when the trigger 16 is squeezed, and the safety lock 20 has been pivoted a threshold amount, a force exerted between respective contacting surfaces of the trigger 16 and of the safety lock 20 as a result of the trigger 16 being squeezed may provide a pivotal force against the safety lock 20, which may urge the safety lock toward the second position. It will be appreciated that the geometries and shapes of the trigger 16 and the safety lock 20 (including the relative angle between the safety lock 20 and the trigger 16 when the safety lock 20 is in the first position) may be varied to control the threshold pivotal movement of the safety lock 20 before a squeezing force on the trigger 16 may urge the safety lock toward the second position.

Figure 4:
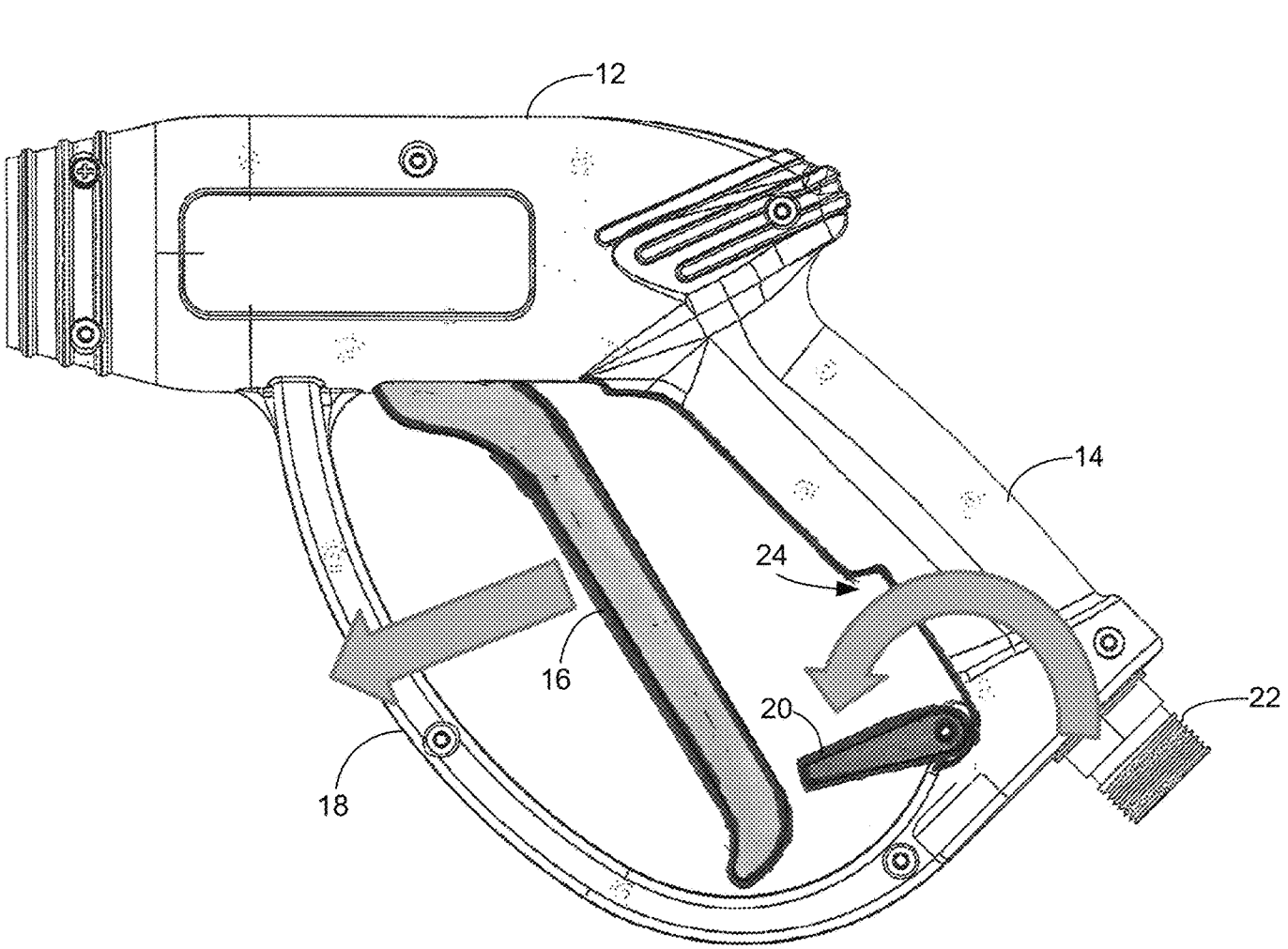
FIG. 4 depicts the illustrative example of the pressure washer gun according to FIG. 1 with the trigger returned to the released position.

With continued reference to FIG. 3, once the safety lock 20 has been pivoted to the second position, and the trigger 16 has been squeezed (e.g., to open the valve and permit flow of the high pressure fluid through the gun 10), the position of the trigger 16 (and/or the squeezing force applied to the trigger 16) may maintain the safety lock 20 in the second position. With reference also to FIG. 4, when the trigger 16 is released and allowed to move to an initial position (e.g., in which the valve is closed to prevent the flow of high pressure fluid through the gun 10), the bias of the safety lock 20 toward the first position may cause the pivotal movement of the safety lock 20 to the first, "locked," position, thereby resisting and/or preventing the trigger 16 from being subsequently squeezed sufficiently to open the valve, without the safety lock 20 first being pivoted toward the second position (e.g., by the user). As such, simply releasing the trigger 16 may allow the safety lock 20 to return to the locked position, without further additional action being required by a user. Accordingly, the gun 10 may return to the locked, or safe, condition whenever the trigger 16 is released.

In some embodiments, as shown in the illustrated example, the hand grip portion 14 may include a recess 24 adjacent to the safety lock 20. In such an implementation, when the safety lock 20 is in the second, "unlocked," position, the safety lock 20 may be at least partially disposed within the recess 24. In some such embodiments, when the safety lock 20 is at least partially disposed within the recess 24, the safety lock 20 may be generally flush with, and/or at least partially recessed within, the corresponding surface of the hand grip portion 14. In such a configuration, the safety lock 20 may nest with the hand grip portion 14. In other implementations, when the safety lock 20 is in the second position, at least a portion of the safety lock 20 may protrude from the surface of the hand grip 14. In still further implementations, the safety lock 20 may be contoured to wrap around at least a portion of the corresponding surface of the hand grip 14 to provide an at least semi-flush configuration relative to the hand grip portion 14. In still further implementations, the safety lock 20 may extend substantially, if not entirely, beyond the hand grip portion 14 when the safety lock 20 is in the second position. It will be appreciated that combination of the above implementations, as well as other configurations, may be equally utilized.

In the illustrated example embodiment, the safety lock 20 has generally been depicted as being pivotal upwardly (e.g., toward the body portion 12) from the first position to the second position. However, it will be appreciated that other configurations may be equally utilized. For example, the safety lock may pivot downwardly (e.g., away from the body portion) from the first position to the second position. Similarly, the safety lock may pivot laterally relative to the hand grip portion. Other configurations may also be utilized.

Figure 5:
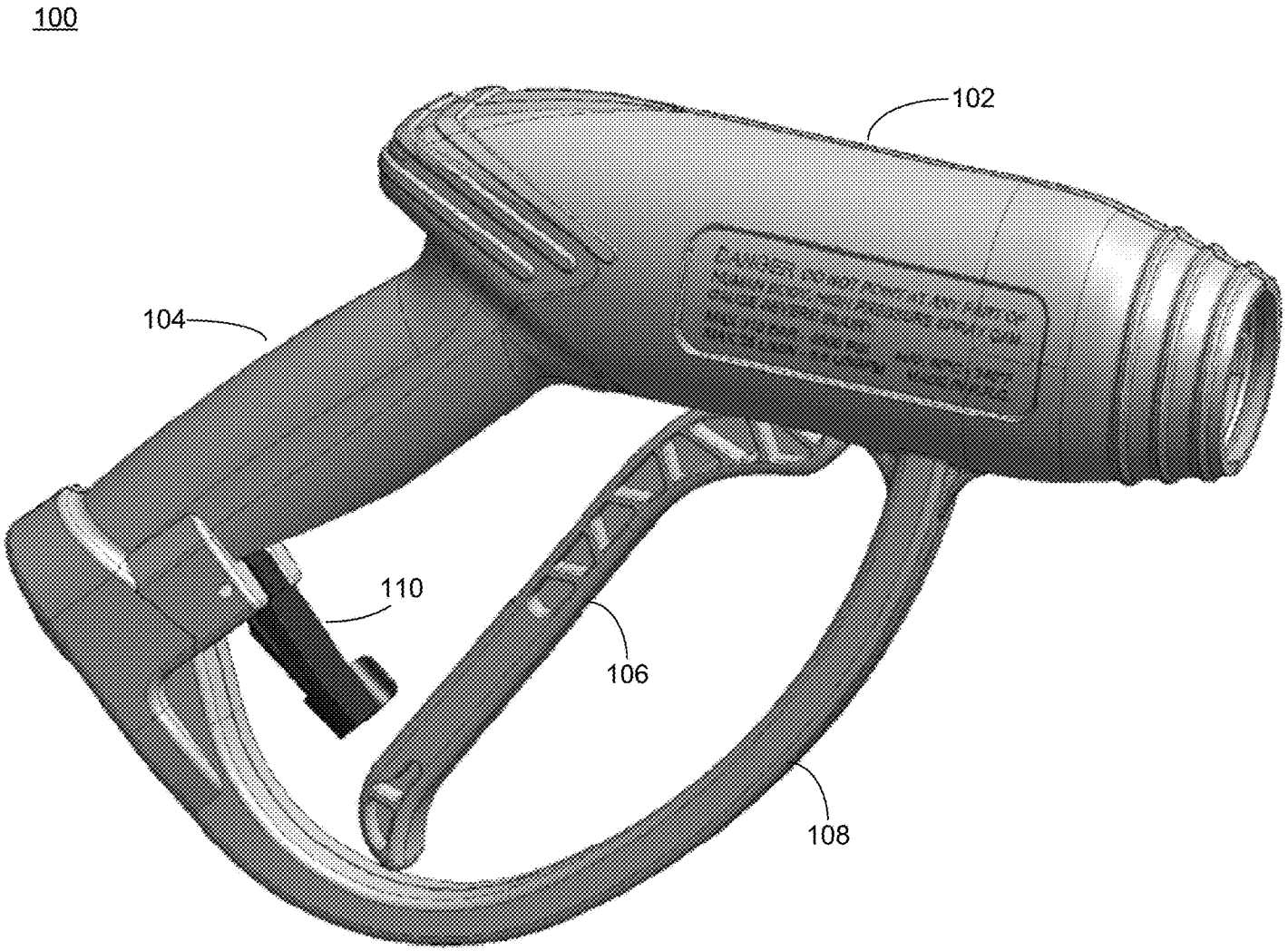
FIG. 5 depicts another illustrative example of a pressure washer gun including a safety lock in the locked position.
Figure 6:
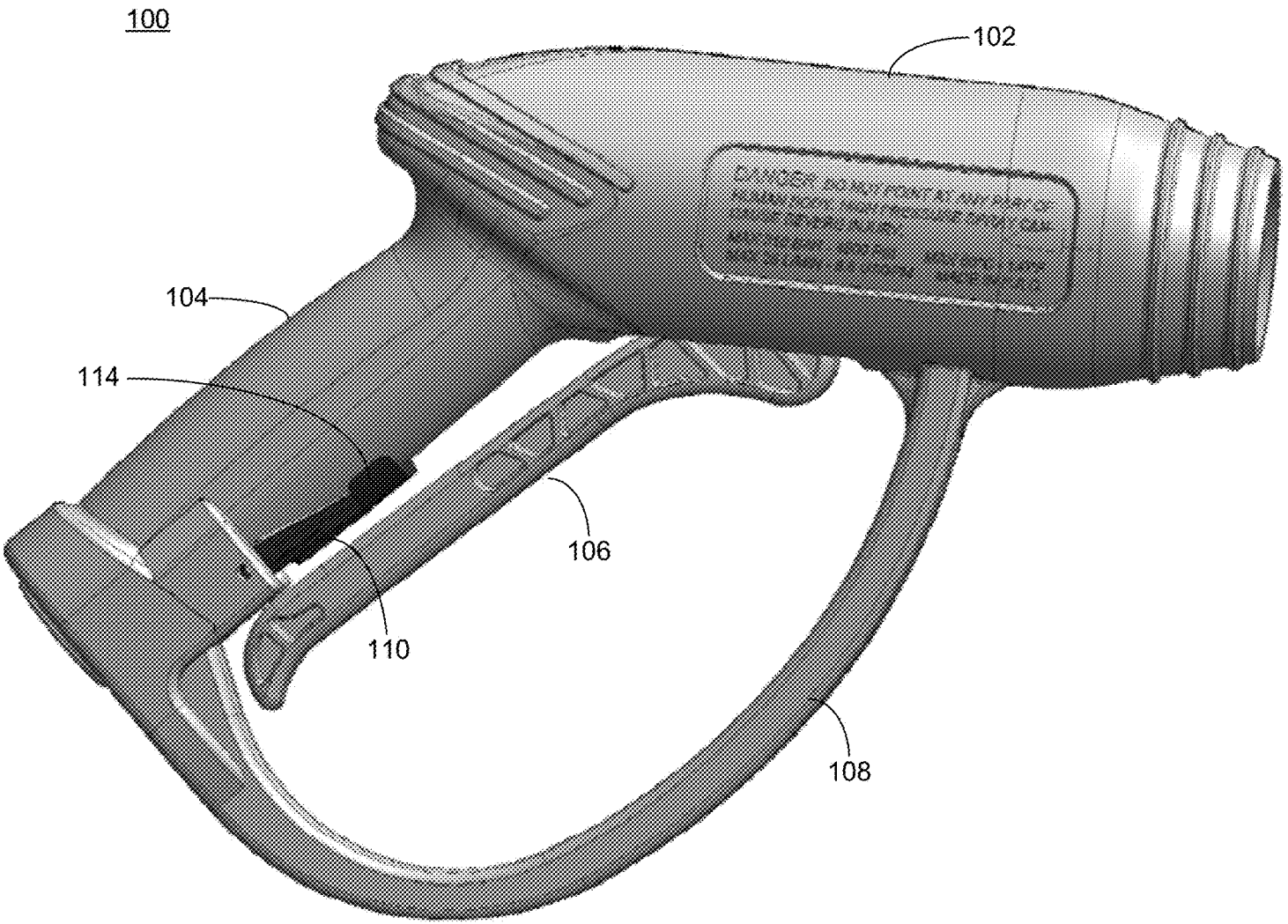
FIG. 6 depicts the pressure washer gun according to FIG. 5 with the safety lock in an unlocked position.
Figure 7:
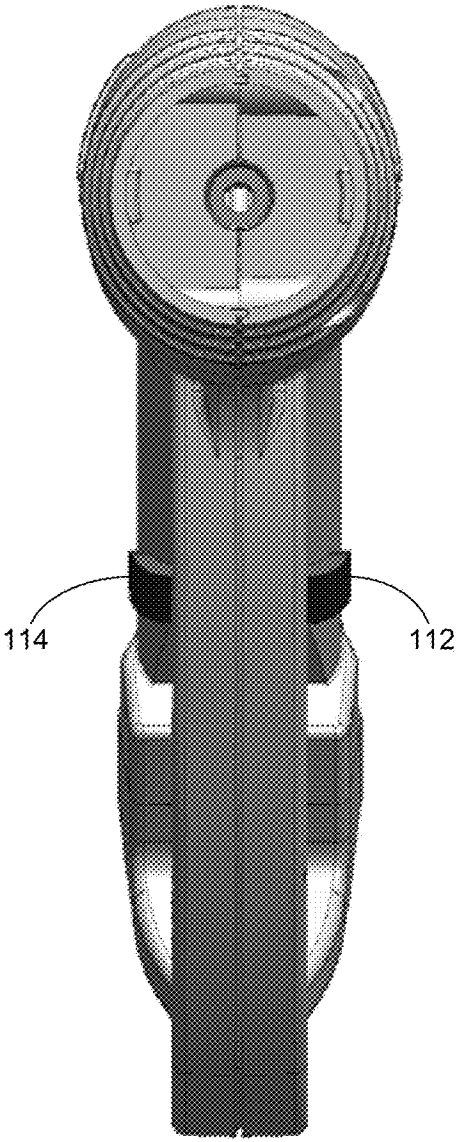
FIG. 7 depicts a frontal view of the pressure washer gun according to FIG. 5 with the safety lock in the unlocked position.

Referring also to FIGS. 5-11, another illustrative example embodiment of a pressure washer gun 100 is depicted. In a similar manner as the previously described illustrative embodiment, the pressure washer gun 100 may generally include a body portion 102, a hand grip portion 104, and a trigger 106, which may be at least partially surrounded and/or protected by a guard 108. Additionally, the pressure washer gun 100 may include a safety lock 110, which may be moveable between a first (locked) position (e.g., as generally shown in FIG. 5), and a second (unlocked) position (e.g., as generally shown in FIG. 6). As generally discussed with respect to FIGS. 1-4, the safety lock 110 may generally be biased toward the first position, in which the safety lock 110 may prevent and/or restrict actuation of the trigger 106, and to thereby prevent the flow control valve from be opened sufficiently to allow flow of the high pressure fluid through the pressure washer gun 100. The safety lock 110 may be pivoted to the second positon (e.g., by a user) in order to allow sufficient actuation of the trigger 106 to permit flow of the high pressure fluid through the pressure washer gun 100.

In some embodiments, once the safety lock has been at least partially pivoted towards the second position (e.g., based upon actuation by a user), pulling the trigger may cause the safety lock to continue to pivot toward the second position. In some such embodiments, once pivoting of the safety lock has been initiated by a user, the further unlocking of the safety lock (e.g., the further pivoting of the safety lock to the second position) may be accomplished by the user squeezing the trigger. Additionally, in some embodiments, maintaining the trigger in a squeezed position may act to maintain the safety lock in the second position (e.g., by preventing the safety lock from rotating back to the first position). It will be appreciated that in some such embodiments, when the trigger is in the squeezed position the safety lock (e.g., the distal end of the safety lock and/or one or more additional portions of the safety lock) may be in contact with the trigger (e.g., as a result of the biasing feature urging the safety lock toward the first position). It will be noted that in FIG. 6 the safety lock is depicted in the second position and the trigger is depicted in the squeezed position, however the safety lock is not shown to be in contact with the trigger. Such depiction is provided for the purpose of clarity in depicting the features of the illustrative pressure washer gun. In some implementations consistent with the illustrative pressure washer gun, when the safety lock is in the second position and the trigger is in the squeezed position, at least a portion of the safety lock may be in contact with the trigger.

With particular reference to FIGS. 5-8, in an embodiment, at least a portion of the safety lock 110 may include one or more laterally extending features (e.g., laterally extending features 112, 114). In an embodiment, the laterally extending features 112, 114 may facilitate actuation of the safety lock 110 by a user (e.g., to pivot the safety lock 110 from the first position to the second position). In a particular implementation, the laterally extending features 112, 114 may facilitate actuation of the safety lock 110 while reducing the likelihood of a user pinching a finger between the trigger 106 and the hand grip portion 104/safety lock 110 as it may not be necessary to reach between the trigger 106 and the hand grip portion 104/safety lock 110 to rotate the safety lock 110 from the first position to the second position. For example, the laterally extending features 112, 114 may extend laterally a width greater than the width of the trigger 106. In some situations, the laterally extending features 112, 114 may particularly facilitate operating the safety lock 110 using a finger of the same hand that is gripping the pressure washer gun 100. Further, the laterally extending features 112, 114 may include ridges, stippling, or other surface characteristics that may increase the grip or traction of the safety lock 110, e.g., to further facilitate actuation of the safety lock 110. While the illustrated embodiment is shown including two laterally extending features (e.g., one feature extending to either side of the safety lock), in other embodiments, only a single laterally extending feature may be utilized. Further, while the laterally extending features have been depicted as generally extending from the distal end of the safety lock, in other implementations the laterally extending features may extend from a generally central portion of the safety lock, a generally proximal portion of the safety lock, and/or may extend along a greater expanse of the safety lock.

In some implementations, the laterally extending features may include contoured features. For example, the laterally extending features 112, 114 may be at least partially, if not entirely, contoured in a generally complimentary manner to the shape of the hand grip portion 104. In such an implementation, when the safety lock 110 is in the second position, the laterally extending features 112, 114 may at least generally conform to the shape of the hand grip portion 104. In some such implementations, the contoured shape of the laterally extending features 112, 114 may provide a more ergonomic shape, e.g., which may improve the comfort associated with the pressure washer gun 100. Further, while not shown, in some embodiments the hand grip portion 104 may include recesses that may be generally complimentary to the laterally extending features 112, 114. In such an implementation, when the safety lock 110 is in the second position, the laterally extending features may be at least partially disposed within and/or adjacent to the recesses. Such a configuration may, in some situations, reduce the degree to which the laterally extending features protrude from the hand grip portion 104. In some situations, the foregoing configuration may provide further enhanced ergonomics for the pressure washer gun 100.

Figure 8:
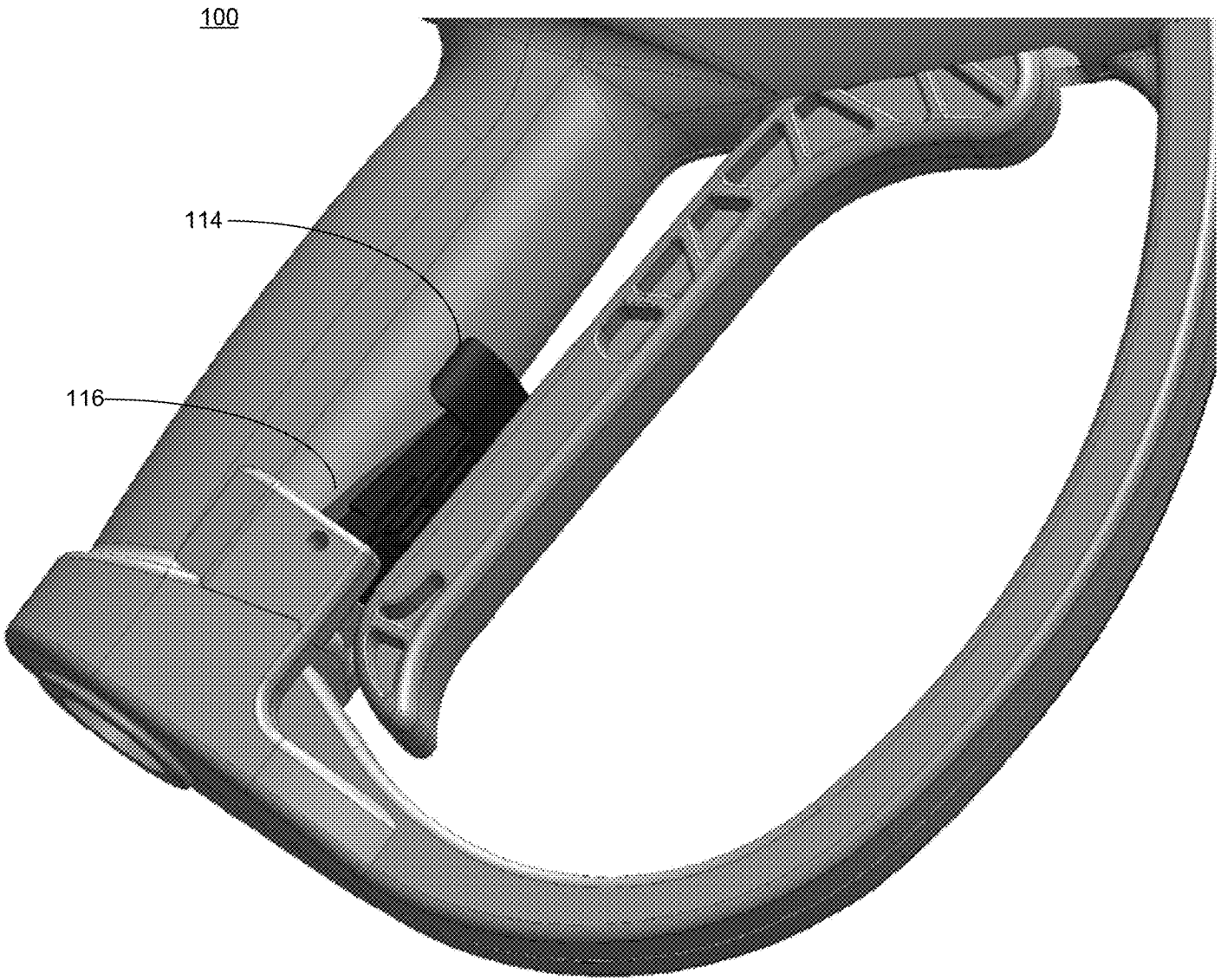
FIG. 8 is an enlarged view of the safety lock portion of the pressure washer gun according to FIG. 5 with the safety lock in the unlocked position.
Figure 9:
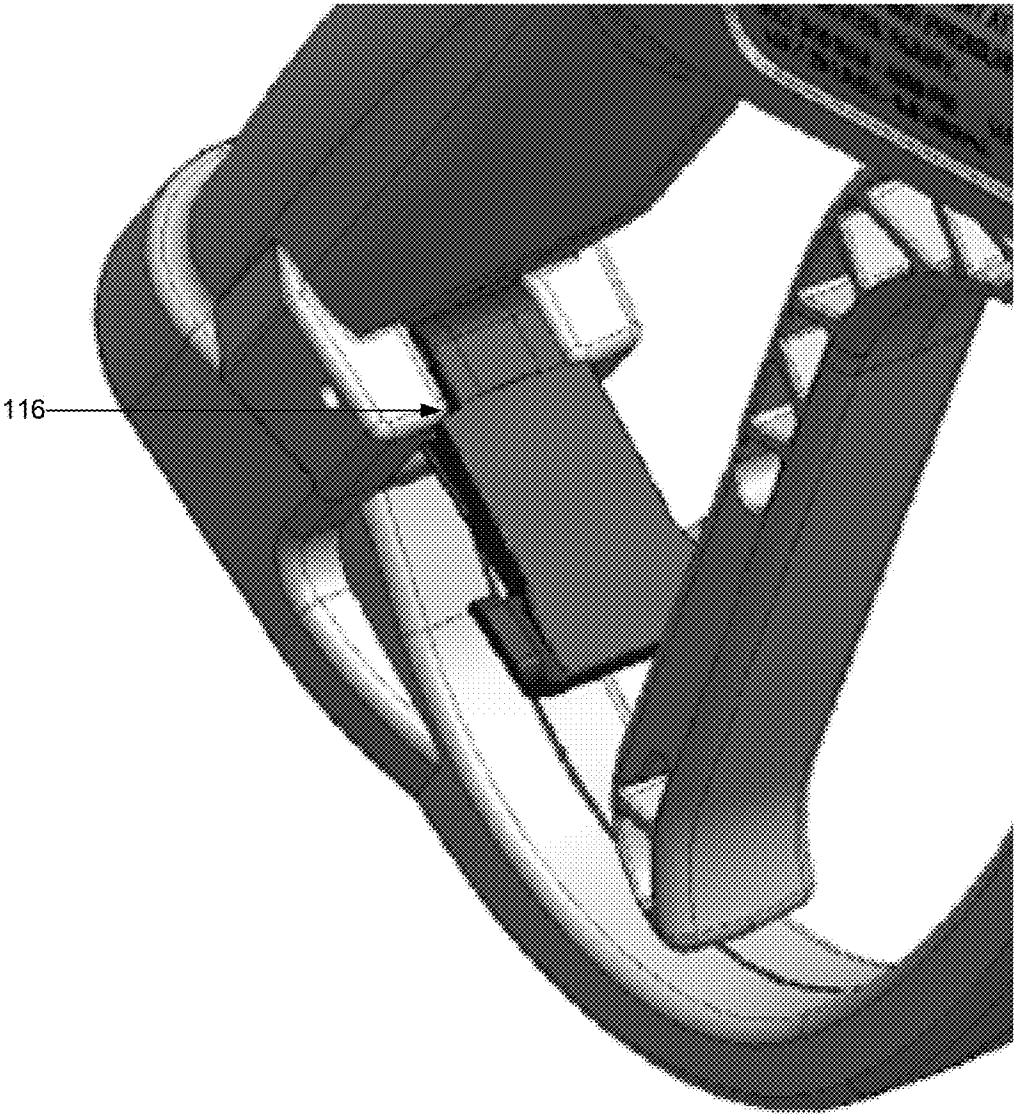
FIG. 9 is an enlarged view of the safety lock portion of the pressure washer gun according to FIG. 5 with the safety lock in the locked position.

With further reference to FIGS. 8 and 9, in an embodiment the safety lock 110 may include a stop feature 116. In general, the stop feature 116 may interact with at least a portion of the hand grip portion 104 to resist and/or restrict movement of the safety lock 110 beyond the first position. For example, in an embodiment the safety lock 110 may be configured to be generally perpendicular to the trigger 106 when the safety lock is in the first position. In such a configuration squeezing the trigger 106 against the safety lock 110 may apply a force generally along the axis of the safety lock 110, and may not tend to impart a rotational force on the safety lock 110. It will be appreciated that when the safety lock 110 is oriented generally non-perpendicularly to the trigger 106, squeezing the trigger 106 against the safety lock 110 may impart some degree of rotational force on the safety lock 110 (e.g., depending, at least in part, on the angle between the trigger and the safety lock), which may cause the safety lock 110 to pivot away from the first position. Consistent with the illustrated embodiment, the stop feature 116 may aid in orienting the safety lock 110 generally perpendicularly to the trigger 106 when the safety lock is in the first position. As such, the stop feature 116 may, in some embodiments, prevent the biasing force on the safety lock 110 from orienting the safety lock 110 beyond perpendicular to the trigger 106, whereby squeezing the trigger 106 may cause the safety lock 110 to rotate downwardly (in the illustrated embodiment) and allow inadvertent opening of the flow control valve and/or jamming of the safety lock 110 between the trigger 106 and the guard 108. As shown in the illustrated embodiment, the stop feature 116 may include a generally lateral extension of the safety lock 110 that may engage with an adjacent portion of the hand grip portion 104. However, it will be appreciated that additional and/or alternative configurations may also be utilized, such as, for example, downwardly extending features or tabs from the bottom of the safety lock that may engage portions of the hand grip portion, as well as other suitable configurations and features.

Figure 10:
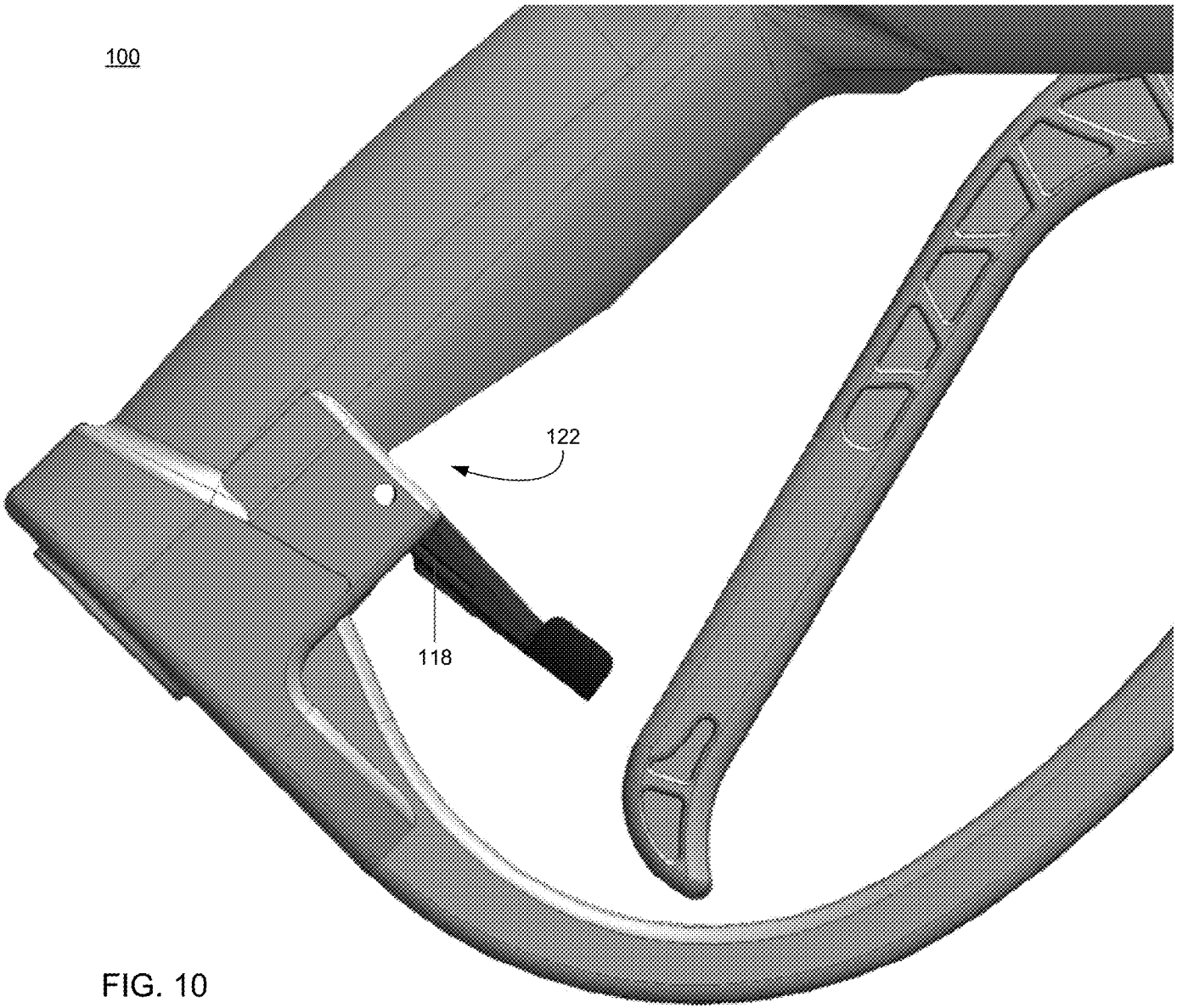
FIG. 10 is an enlarged view of the safety lock portion of the pressure washer gun according to FIG. 5 with the safety lock in the locked position.
Figure 11:
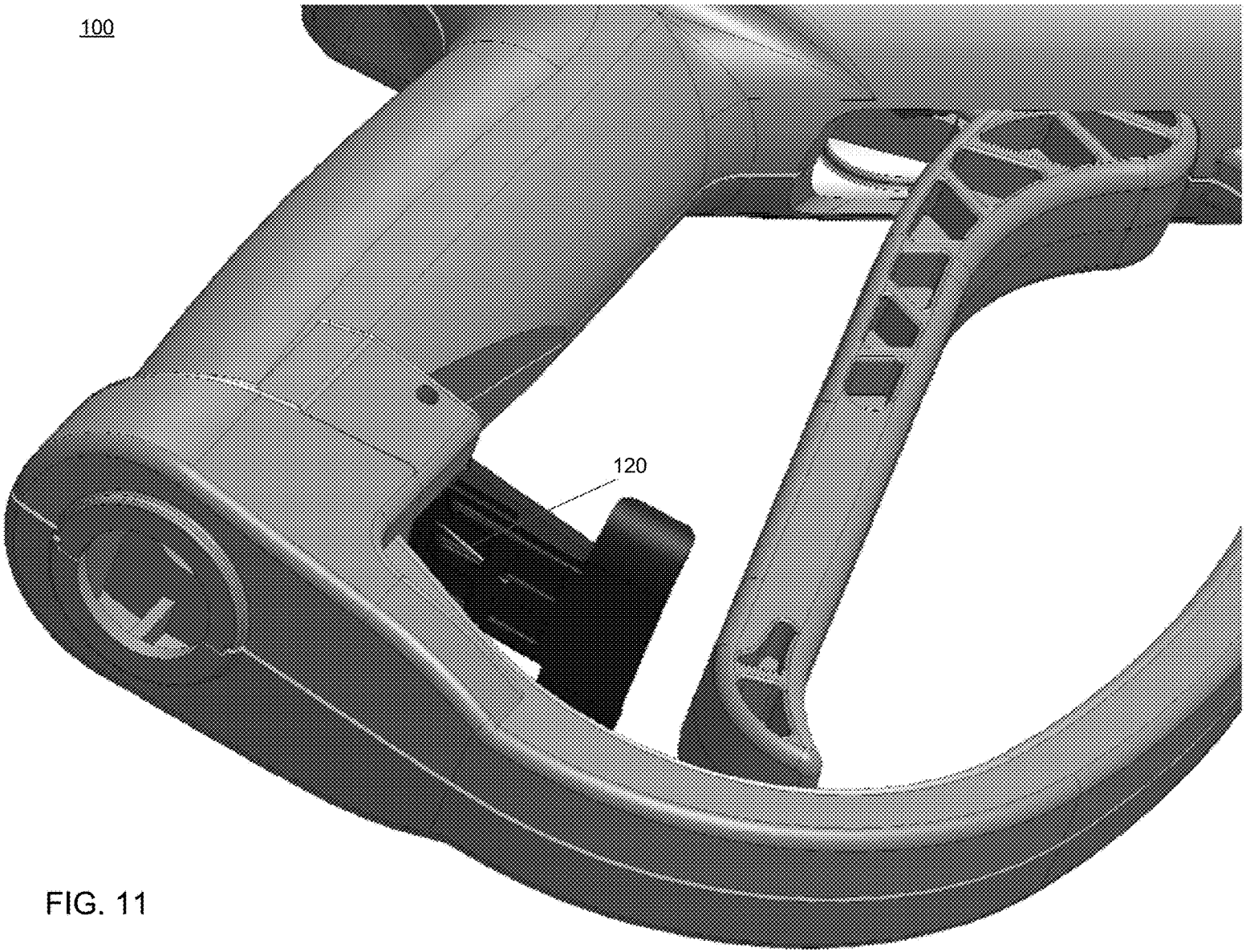
FIG. 11 is an enlarged view of the underside of the safety lock portion of the pressure washer gun according to FIG. 5 with the safety lock in the locked position.

Referring also to FIGS. 10 and 11, in an embodiment the safety lock 110 may be biased toward the first position by a torsion spring, e.g., which may act between the safety lock 110 and the hand grip portion 104 (and/or another component of the pressure washer gun 100). In an embodiment the safety lock 110 may include a channel 118 or groove formed in the side of the safety lock 110. A leg of the torsion spring acting against the safety lock 110 may be at least partially disposed within the channel 118. In some implementations, the inclusion of channel 118 may simplify the components, manufacture, and/or assembly of the pressure washer gun 100. In some alternative implementations, as shown in FIG. 11, the underside of the safety lock 110 may include one or more openings, e.g., which may receive a leg 120 of a torsion spring, e.g., which may bias the safety lock 110 toward the first position.

In some implementations, the hand grip portion 104 may include a cutout 122 or recess that may generally receive at least a portion of the safety lock 110 when the safety lock 110 is in the second position. In general, the cutout 122 may all the safety lock 110 to fold up into the second position to generally conform to the profile of the hand grip portion 104, e.g., as generally shown in FIG. 6. In such an implementation, it may not be necessary to allow for additional space between the trigger 106 and the hand grip portion 104 to accommodate the safety lock 110 while still allowing full travel of the trigger 106. In this regard, the spacing between the trigger 106 and the hand grip portion 104 (e.g., when the safety lock 110 is in the first position) may be reduced to thereby give a relatively smaller grip, e.g., which may provide enhanced comfort of use for a greater range of users (e.g., who may have different size hands).

Figure 12A:
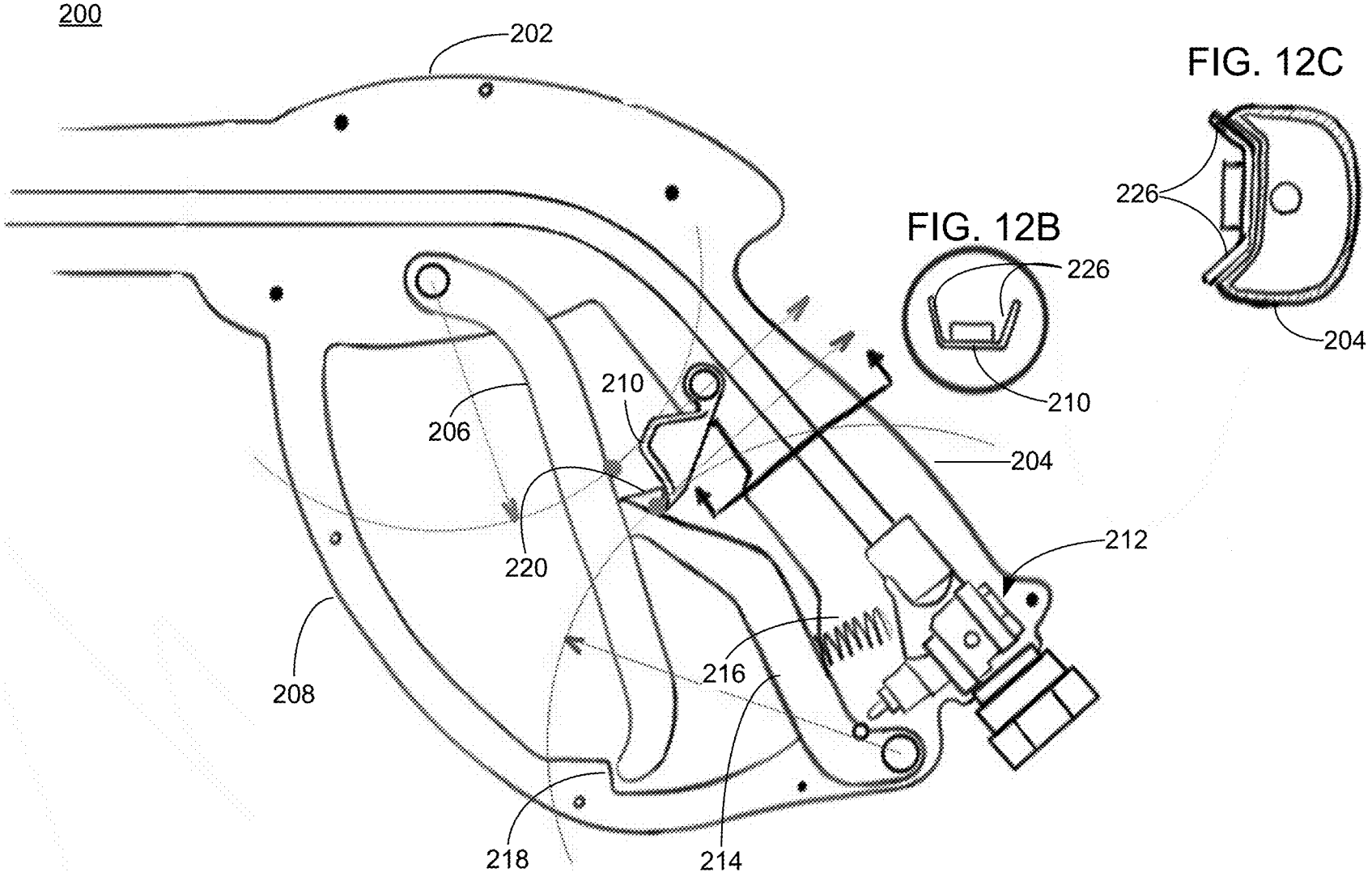

As generally discussed above, in some implementations, the trigger of the pressure washer gun may be coupled with the flow control valve through one or more intermediary features, linkages, or the like. For example, and referring to FIG. 12A, an illustrative example embodiment of a pressure washer gun 200 is shown. As generally described with respect to the preceding embodiments, the pressure washer gun 200 may generally include a body portion 202, a hand grip portion 204, and a trigger 206, which may be at least partially surrounded and/or protected by a guard 208. Additionally, the pressure washer gun 200 may include a safety lock 210, which may be moveable between a first (locked) position (e.g., as generally shown in FIG. 12A), and a second (unlocked) position. As generally discussed with respect to the preceding embodiments, the safety lock 210 may generally be biased toward the first position, in which the safety lock 210 may prevent and/or restrict the flow control valve from be opened sufficiently to allow flow of the high pressure fluid through the pressure washer gun 200. The safety lock 210 may be pivoted to the second positon (e.g., by a user) in order to allow the flow control valve to be sufficiently opened to allow the flow of the high pressure fluid through the pressure washer gun 200.

Consistent with the illustrated embodiment, the trigger 206 may be coupled with a flow control valve (e.g., flow control valve 212) via an intermediary linkage 214. In the illustrated embodiment, the intermediary linkage 214 may be pivotally coupled to the hand grip portion 204 and/or to the guard 208. As shown, the intermediary linkage may extend between the flow control valve 212 and the trigger 206. Consistent with the illustrated embodiment, the trigger 206 may be actuated by a user, e.g., causing the trigger 206 to pivot relative to the body portion 202. Pivoting of the trigger 206 may cause the trigger to engage the intermediary linkage 214. In an embodiment, the intermediary linkage 214 may slidingly engage a rear-facing surface of the trigger 206. As such, the pivoting of the trigger 206 may engage the intermediary linkage 214, which may slide along the rear-facing surface of the trigger 206 causing the intermediary linkage 214 to pivot toward the hand grip portion 204 and engage the flow control valve 212. Upon sufficient pivoting movement, the intermediary linkage 214 may actuate the flow control valve 212 to move the flow control valve to an at least partially opened position, allowing the flow of pressurized fluid through the pressure washer gun 200.

In an example embodiment, the rear-facing surface of the trigger 206 may include a concave, or C-shaped, profile along at least a portion of the interacting surface with the intermediary linkage 214. Further, in some embodiments, the intermediary linkage 214 may include rounded or convex profile at the point of contact between the intermediary linkage 214 and the rear-facing surface of the trigger 206. Such a configuration may facilitate sliding movement of the intermediary linkage 214 along the rear-facing surface of the trigger 206 and/or may aid in lateral alignment between the intermediary linkage 214 and the trigger 206 during the interaction between the features.

Additionally, in some embodiments, the intermediary linkage 214 may be biased toward a position in which the flow control valve 212 may be in the closed position. For example, as shown, a spring 216 may act against at least a portion of the intermediary linkage 214 urging the intermediary linkage 214 toward a closed position of the flow control valve 212. While the illustrated embodiment is depicted utilizing an expansion spring for urging the intermediary linkage 214 toward the closed position of the flow control valve 212, it will be appreciated that other biasing arrangements may be utilized (e.g., torsion springs, springs associated with the flow control valve itself, and the like). In some implementations, as shown in the illustrated example embodiment, biasing the intermediary linkage 214 may urge the intermediary linkage 214 into contact with the trigger 206, and may urge the trigger toward a closed position of the flow control valve 212 (e.g., a forward position of the trigger 206 in the illustrated embodiment). In such an embodiment, the biasing of the intermediary linkage 214 may maintain the intermediary linkage 214 in contact with the trigger 206. In some implementations, maintaining contact between the intermediary linkage 214 and the trigger may facilitate maintaining alignment between the interacting surfaces of the intermediary linkage 214 and the trigger 206 (which, in some embodiments, may not be physically coupled to one another). In some embodiments, contact between the intermediary linkage 214 and the trigger 206 may be maintained through the use of a forward travel stop, e.g., which may limit the extent of forward travel of the trigger 206 within a range of travel of the intermediary linkage 214 provided by the spring 216, or other biasing element. In the illustrated embodiment, the forward travel stop may include a stop feature 218 associated with the guard 208 that may engage a portion of the trigger 206. It will be appreciated that other stop features, associated with one or more of the body portion 202, the hand grip portion 204 and the guard 208 may equally be utilized.

Figure 13:
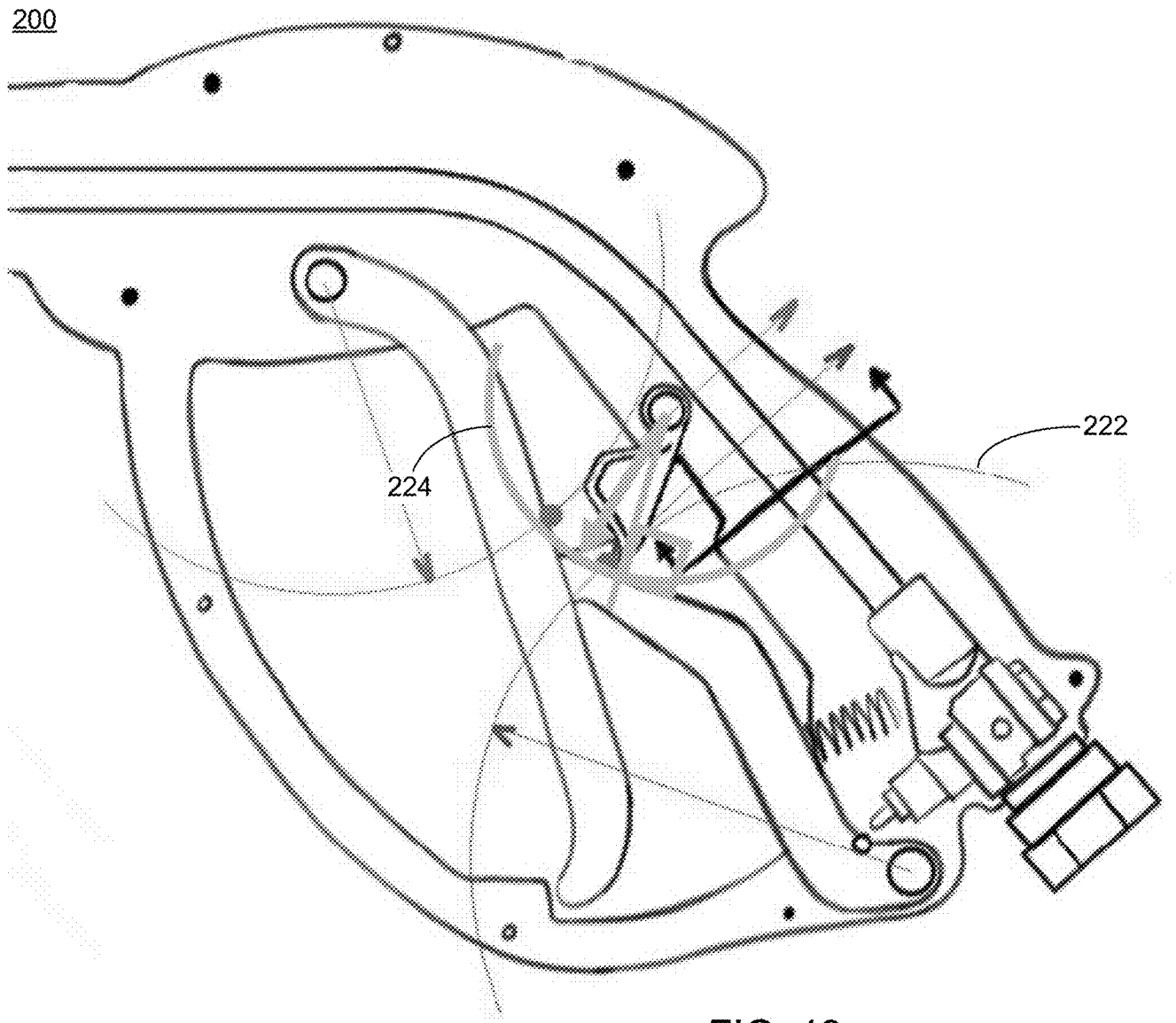
FIG. 13 depicts the pressure washer gun of FIG. 12A along with various representations of rotational arc lines of the safety lock.

As generally described with relation to the preceding embodiments, the safety lock 210 may be moveable between a first (locked) position (e.g., as generally shown in FIG. 12A), and a second (unlocked) position. As shown in FIGS. 12A and 13, in the locked position, the safety lock 210 may be oriented relative to the intermediary linkage 214 such that a rotational force applied to the intermediary linkage 214 (e.g., as a result of a rotational force applied to the trigger 206) may not cause the safety lock 210 to rotate toward the unlocked position. That is, a rotational force applied to the intermediary linkage 214 may not cause the safety lock 210 to collapse toward the unlock position. In an example embodiment, such an arrangement may be achieved by positioning the safety lock 210 at, or beyond, perpendicular to the contact surface of the intermediary linkage 214 when the safety lock 210 is in the locked position. As such, until the safety lock 210 is rotated inside of such a perpendicular orientation relative to the contacting surface of the intermediary linkage 214, the safety lock 210 may resist unintentionally collapsing toward the unlocked position, e.g., if a user squeezes the trigger 206, etc. In some embodiments, once the safety lock 210 has been rotated inside of the perpendicular orientation, a rotational force applied to the intermediary linkage 214 (e.g., by a user squeezing the trigger 206) may further urge the safety lock 210 to the unlocked position and/or allow the safety lock 210 to be maintained in the unlocked position. As such, it may only be necessary for a user to initially move the safety lock 210 toward the unlocked position (e.g., passed the perpendicular orientation) while squeezing the trigger 206 to fully effectuate unlocking of the trigger 206 and/or maintaining the unlocked configuration. As such, use of the pressure washer gun 200 may be convenient while providing a desired degree of protection against unintended opening of the flow control valve.

With additional reference to FIG. 13, in an embodiment, and as generally discussed above, the safety lock 210 may be biased toward the locked position (e.g., by a spring, such as a torsion spring). As shown, the travel of the safety lock 210 toward the locked position may be at least partially established by a stop feature 220 associated with the intermediary linkage 214. As shown in the illustrated embodiment, the stop feature 220 may include a protrusion, or other feature, associated with the intermediary linkage 214. It will be appreciated that other features, associated with the intermediary linkage 214, the trigger 206, the hand grip portion 204, the body portion 202, or another feature of the pressure washer gun 200, may be employed to at least partially established to the fully locked position of the safety lock 210. As shown, in an example embodiment the fully locked positon of the safety lock 210 (e.g., as established by the stop feature 220) may reside at, or beyond, the intersection between a rotational arc 222 of the intermediary linkage 214 and a rotational arc 224 of the safety lock 210. Consistent with such an embodiment, and as described above, when the safety lock 210 is in the locked position, a rotational force applied to the intermediary linkage 214 may not cause the safety lock 210 collapse toward the unlocked position. Further, in some example embodiments, when the fully locked position of the safety lock 210 is outside of the intersection of the rotational arc 222 of the intermediary linkage 214 and the rotational arc 224 of the safety lock 210, a rotational force applied to the intermediary linkage 214 may urge the safety lock 210 toward the stop feature 220. Urging the safety lock 210 toward the stop feature 220 may further reinforce the locked configuration of the safety lock 210, such as by causing the safety lock 210 to bind against the stop feature 220.

As discussed with respect to preceding embodiments, in some implementations the safety lock may include one or more lateral protrusions, e.g., which may facilitate operation of the safety lock by a user and/or improve the ergonomics of the pressure washer gun, e.g., by reducing any intrusively shaped points of contact with the user's hand during operation of the pressure washer gun. For example, and referring also to FIGS. 12B and 12C, a cross-sectional profile of the safety lock 210 is shown illustrating the configuration of the lateral protrusions 226 of the safety lock 210. In the illustrated embodiment, the lateral protrusions 226 may be generally outwardly angled. In some embodiments, the lateral protrusions may extend laterally a width greater than a width of the trigger 206 and/or of the intermediary linkage 214. As such, the lateral protrusions may facilitate operation of the safety lock 210 by a user, e.g., moving the safety lock 210 toward an unlocked position. Additionally, as shown in FIG. 12C, in an embodiment, the hand grip portion 204 may include a recess and a contour that may generally cooperate with the shape of the safety lock 210, e.g., to allow the safety lock 210 to at least partially nest with the hand grip portion 204 when the safety lock 210 is in the unlocked position.

Figures 14A, 14B, 14C:
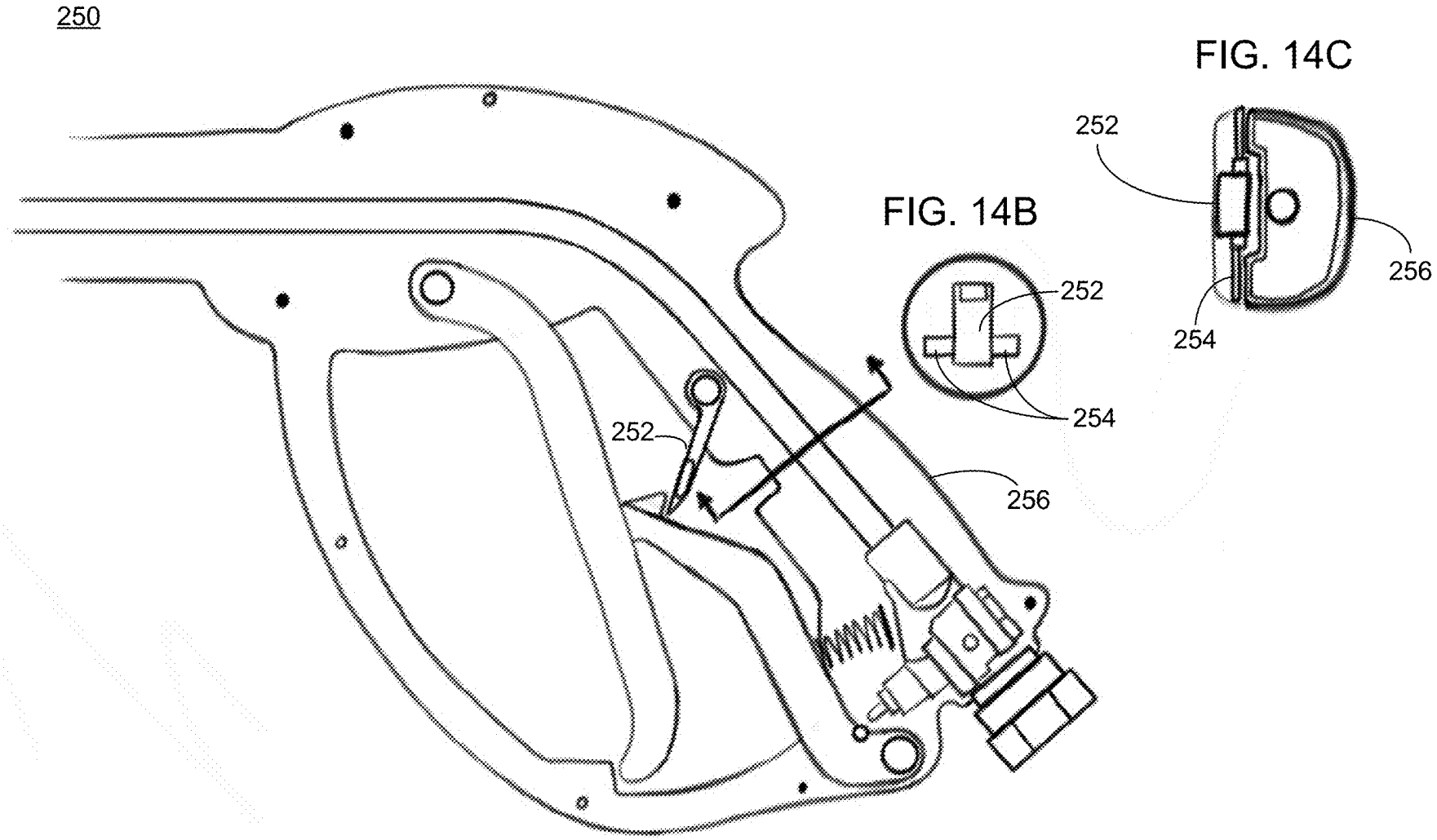
FIGS. 14A-14C depict another illustrative example of a pressure washer gun including a safety lock.

Referring to FIGS. 14A through 14C, a further embodiment of a pressure washer gun 250 is shown. The illustrated example embodiment is generally similar to the example embodiment depicted in FIGS. 12A though 12C. As shown, the pressure washer gun 250 may include a safety lock 252 including lateral protrusions 254. In the illustrated embodiment, the lateral protrusions 254 may generally include straight protrusions, or wings, extending from the sides of the safety lock 252. As with previously described embodiments, the lateral protrusions may have a lateral width that may be greater than a lateral width of the trigger and/or intermediary linkage, thereby facilitating operation of the safety lock 252 by a user. Additionally, the grip portion 256 of the pressure washer gun 250 may include a recess that may allow the safety lock to at least partially nest within the grip portion 256 when the safety lock is in the unlocked position.

A variety of features of example implementations of a safety lock mechanism for a pressure washer gun have been described. However, it will be appreciated that various additional features and structures may be implemented in connection with a safety lock mechanism according to the present disclosure. Additionally, it will be appreciated that the various features and attributes of the several embodiments may be combined to provide additional implementations consistent with the present disclosure. As such, the features and attributes described herein should be construed as a limitation on the present disclosure.

What is claimed is:

1. A pressure washer gun comprising:

a body portion;

a hand grip portion extending from the body portion;

a trigger disposed adjacent to the hand grip portion and pivotally coupled relative to the body portion;

a linkage pivotally coupled relative to the hand grip portion, and interacting with the trigger for pivotal movement of the linkage in response to pivotal movement of the trigger, the linkage coupled with a flow control valve for controlling a flow of fluid through the pressure washer gun; and a safety lock pivotally coupled with the hand grip portion for movement between a locked position extending outwardly from a front exterior surface of the handgrip portion, oriented one of substantially perpendicularly relative to the linkage and greater than perpendicular relative to the linkage for inhibiting movement of the linkage to open the flow control valve, and an unlocked position, folded between the linkage and the handgrip portion, allowing movement of the linkage to open the flow control valve, the safety lock being biased toward the locked position, wherein the safety lock is pivotally moveable between the locked position and the unlocked position, and wherein in the locked position a rotational force applied to the intermediary linkage urges the safety lock toward a stop feature associated with one or more of the intermediary linkage and the safety lock, and wherein the safety lock includes one or more laterally extending features extending laterally a width greater than a width of the trigger.

2. The pressure washer gun according to claim 1, wherein at least one surface of the linkage slidingly contacts at least one surface of the trigger during pivotal movement of the trigger to result in pivotal movement of the linkage.

3. The pressure washer gun according to claim 1, wherein the linkage is biased against the trigger toward a closed position of the flow control valve.

4. The pressure washer gun according to claim 3, further comprising a guard extending around at least a portion of the trigger, the guard including a stop feature establishing a fully open position of the trigger.

5. The pressure washer gun according to claim 1, wherein the safety lock extends between the linkage and the hand grip portion in the locked position.

6. The pressure washer gun according to claim 1, wherein the safety lock is at least perpendicular to a contacting surface of the linkage in the locked position.

7. The pressure washer gun according to claim 1, wherein in the locked position the safety lock contacts the linkage outside of an intersection between a rotational arc associated with the linkage and a rotational arc associated with the safety lock.

8. The pressure washer gun according to claim 1, wherein the hand grip portion includes a recess, and wherein the safety lock is at least partially disposed within the recess when the safety lock is in a fully unlocked position.

9. The pressure washer gun according to claim 1, wherein the laterally extending features have a contour complementary to a contour of an adjacent region of the hand grip portion.

10. A pressure washer gun comprising:

a body portion;

a hand grip portion extending from the body portion, and including a flow control valve at least partially disposed therein, the flow control valve controlling a flow of fluid through the pressure washer gun;

a trigger disposed adjacent to the hand grip portion and pivotally coupled relative to the body portion;

a linkage pivotally coupled relative to the hand grip portion and slidingly contacting the trigger for pivotal movement of the linkage in response to pivotal movement of the trigger, the linkage coupled with the flow control valve;

a safety lock pivotally coupled with the hand grip portion for movement between a locked position extending outwardly from a front exterior surface of the handgrip portion and the linkage, oriented one of substantially perpendicularly relative to the linkage and greater than perpendicular relative to the linkage for inhibiting movement of the linkage to open the flow control valve, and an unlocked position, folded between the linkage and the handgrip portion, allowing movement of the linkage to open the flow control valve, the safety lock being biased toward the locked position, wherein the safety lock is pivotally moveable between the locked position and the unlocked position, and wherein in the locked position a rotational force applied to the intermediary linkage urges the safety lock toward a stop feature associated with one or more of the intermediary linkage and the safety lock, and wherein the safety lock includes one or more laterally extending features extending laterally a width greater than a width of the trigger; and a guard extending around at least a portion of the trigger, the guard including a stop feature establishing a fully open position of the trigger.

11. The pressure washer gun according to claim 10, wherein the safety lock extends between the linkage and the hand grip portion in the locked position.

12. The pressure washer gun according to claim 10, wherein the safety lock is at least perpendicular to a contacting surface of the linkage in the locked position.

13. The pressure washer gun according to claim 10, wherein the hand grip portion includes a recess, and wherein the safety lock is at least partially disposed within the recess when the safety lock is in a fully unlocked position.

14. The pressure washer gun according to claim 10, wherein the laterally extending features have a contour complementary to a contour of an adjacent region of the hand grip portion.

* * * * *